United States Patent [19]

Calderon et al.

[11] Patent Number: 4,551,232

[45] Date of Patent: Nov. 5, 1985

[54] PROCESS AND FACILITY FOR MAKING COKE SUITABLE FOR METALLURGICAL PURPOSES

[75] Inventors: Jose L. Calderon, Caracas; Humberto Betancourt, Corralito Estado Miranda, both of Venezuela

[73] Assignee: Intevep, S.A., Caracas, Venezuela

[21] Appl. No.: 465,210

[22] Filed: Feb. 9, 1983

[51] Int. Cl.[4] ..... C10G 7/00; C10G 9/14

[52] U.S. Cl. ..... 208/92; 208/131; 202/84; 196/46

[58] Field of Search ..... 208/131, 92, 85, 251 R; 202/84, 209; 196/46, 105

[56] References Cited

U.S. PATENT DOCUMENTS

| | | | |
|---|---|---|---|
| 2,717,865 | 9/1955 | Kimberlin et al. | 208/131 |
| 2,844,524 | 7/1958 | Ernst, Jr. | 208/92 |
| 2,847,359 | 8/1958 | Beuther et al. | 208/92 |
| 3,617,480 | 11/1971 | Keel | 208/131 |
| 3,637,483 | 1/1972 | Carey | 208/92 |
| 3,673,080 | 6/1972 | Schlinger et al. | 208/131 |
| 3,769,200 | 10/1973 | Folkins | 208/131 |
| 3,775,290 | 11/1973 | Peterson et al. | 208/92 |
| 4,049,538 | 9/1977 | Hayashi et al. | 208/131 |
| 4,075,084 | 2/1978 | Skripek et al. | 208/92 |
| 4,130,475 | 12/1978 | Cameron et al. | 208/131 |
| 4,178,229 | 12/1979 | McConaghy et al. | 208/131 |

*Primary Examiner*—William R. Dixon, Jr.
*Assistant Examiner*—Cynthia A. Prezlock
*Attorney, Agent, or Firm*—Bachman & LaPointe

[57] ABSTRACT

Process and facility for upgrading heavy hydrocarbonaceous materials for making coke suitable for metallurgical purposes comprises mixing the heavy hydrocarbonaceous materials with a diluent having a closely controlled boiling range and subjecting the oil diluent mixture to distillation and careful fractionation so as to maximize liquid yields in the coking step.

13 Claims, 1 Drawing Figure

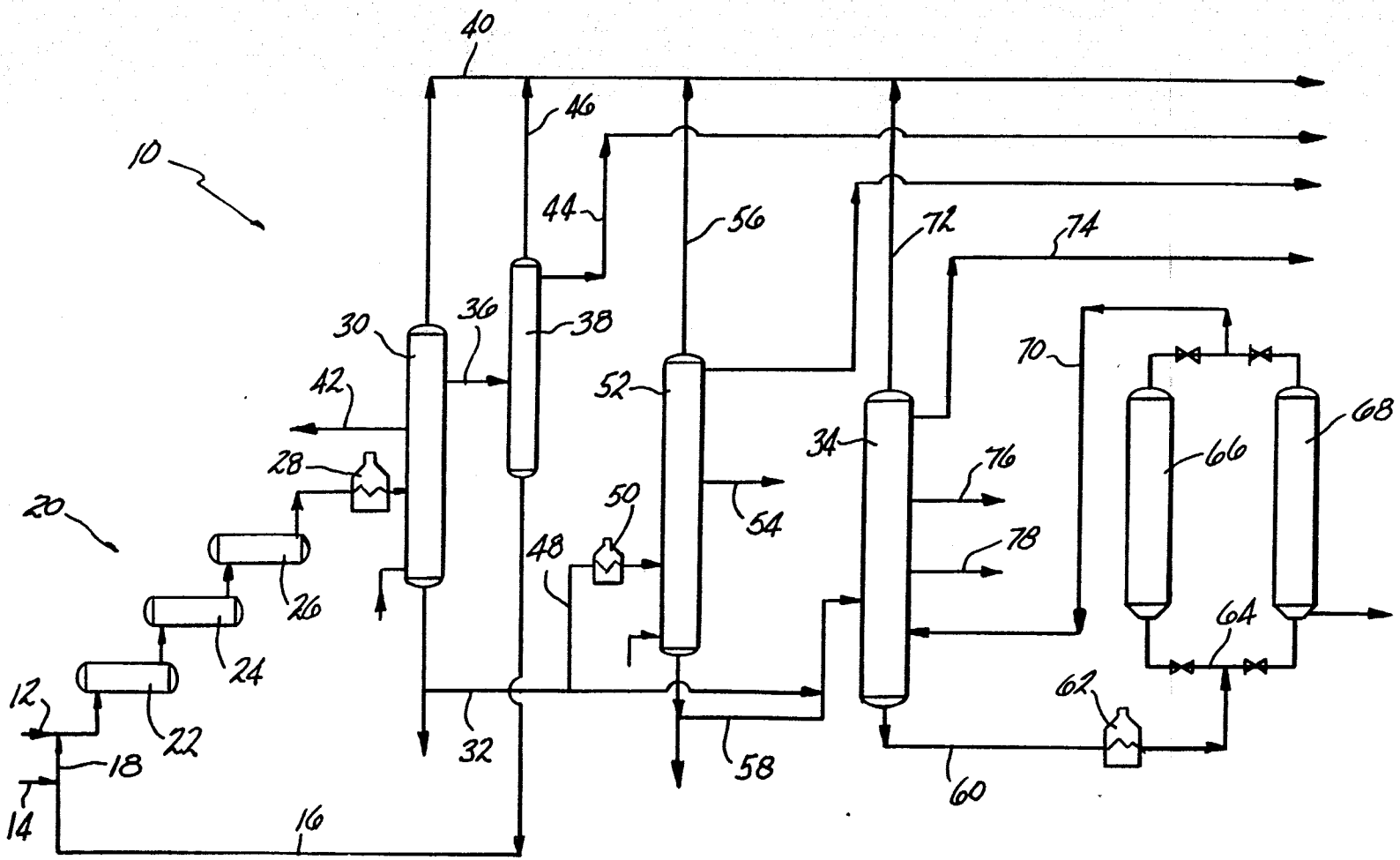
10
12
14
16
18
20
22
24
26
28
30
32
34
36
38
40
42
44
46
48
50
52
54
56
58
60
62
64
66
68
70
72
74
76
78

PROCESS AND FACILITY FOR MAKING COKE SUITABLE FOR METALLURGICAL PURPOSES

BACKGROUND OF THE INVENTION

The present invention relates to a process and facility for upgrading heavy hydrocarbonaceous materials, and more particularly, a process and facility for upgrading heavy crude oils generally characterized by high specific gravities, high pour points, high viscosities and high contents of sulfur, metals, water, salt and conradson carbon for making coke suitable for metallurgical purposes.

In the typical delayed coking process, residual oil is heated by exchanging heat with liquid products from the process and is fed into a fractionating tower wherein light end products produced in the process or present in the residual oil are separated by distillation. The residual oil is then pumped from the base of the fractionating tower through a tubular furnace under pressure where it is heated to the required temperature and discharged into the bottom of the coke drum. The first stages of thermal decomposition reduce this residual oil to volatile products and a very heavy tar or pitch which further decomposes to yield solid coke particles. The vapors formed during the decomposition produce pores and channels in the coke and pitch mass through which the incoming residual oil from the furnace must pass. The incoming oil and decomposition vapors serve to agitate and maintain the coke mass and residual oil mixture at relatively uniform temperature. This decomposition process is continued until the coke drum is filled with a mass of coke with a small amount of pitch. The vapors formed leave the top of the coke drum and are returned to the fractionating tower where they are fractionated into the desired petroleum cuts. After the coke drum is filled with a mixture of coke particles and some tar, residual vapors are removed, and the coke is removed from the drum by hydraulic or mechanical means. This green delayed petroleum coke has particular crystalline and chemical properties which make it especially suitable for making carbon anodes for the aluminum industry, but the green coke must be calcined or carbonized by further treatment to produce a finished calcined coke product.

Due to the characteristics of the heavy crude oils of the type set forth above they cannot be processed economically by conventional processing. In addition to their low quality these crude oils are extremely temperature sensitive and decompose at relatively low temperatures. The processing and treatment of these crude oils at conventional conditions and in typical refining processes results in the higher operating costs and production of products which are predominantly of little value.

Naturally, it is highly desirable to provide a process and facility for upgrading heavy crude oils so as to allow for the economic production of valuable petroleum products. The process and facility of the present invention should allow for the economic production of coke suitable for metallurgical purposes.

Accordingly, it is a principal object of the present invention to provide a process and facility for upgrading heavy crude oils.

It is a particular object of the present invention to provide a process and facility for upgrading heavy crude oils for use in the production of metallurgical coke.

It is a further object of the present invention to provide a process and facility for upgrading heavy crude oils wherein the crude oil is carefully fractionated to maximize liquid yields during the coking step.

It is a still further object of the present invention to provide a process and facility for upgrading heavy crude oils wherein a hydrocarbon diluent is employed to facilitate control of temperature and residence time thereby prohibiting premature decomposition.

Further objects and advantages of the present invention will appear hereinbelow.

SUMMARY OF THE INVENTION

In accordance with the present invention the foregoing objects and advantages are readily obtained.

The present invention relates to a process and facility for upgrading heavy hydrocarbonaceous materials, and more particularly a process and facility for upgrading heavy crude oils for making coke suitable for metallurgical purposes. The crude oils found in Orinoco Oil Belt of Venezuela are generally characterized by high gravities (close to that of water); high pour points (solid at ambient temperatures); high viscosities; high metals, sulfur, water, salt and conradson carbon contents. In addition, the crude oils are extremely temperature sensitive, that is they easily decompose at low temperatures. The process and facility of the present invention allows for the economic production of petroleum products of upgraded value such as LPG, gasoline, kerosene, jet fuel, diesel oil and gas oils.

The process utilizes a careful fractionation of the crude oil for front end control to maximize liquid yields in the coking step. The process and facility also uses a coker fractionator and coker heater design intended to better control the quantity and quality of the coker recycle stream to minimize gas and coke formation and improve the density of the produced coke. In addition, the process employs the use of a hydrocarbon diluent with a closely controlled boiling range to facilitate transport, dehydration and desalting of the crude oil. Further, the diluent facilitates close control of temperatures and residence times thus avoiding premature decomposition and therewith degradation of coker yields.

BRIEF DESCRIPTION OF THE DRAWING

The FIGURE is a schematic flow diagram illustrating the process and facility of the present invention.

DETAILED DESCRIPTION

The facility 10 and process of the present invention as shown in the drawing depicts the various stages of a delayed coke pilot plant including the facility for upgrading heavy crude oil feedstocks. A typical heavy crude oil feedstock from the Orinoco Oil Belt has the following composition and properties:

TABLE I

| | |
|---|---|
| Gravity °API | 8.0 (1,014 Kg/ms) |
| Sulfur, % wt | 3.71 |
| Mercaptans, wt ppm | Nil |
| Pour Point, °F. | 80 |
| Nitrogen, % wt | 0.60 |
| Water and Sediments, % Vol | 6.4 |
| Salt Content as NaCl, Lbs/1000 BBls. | 500 |
| Conradson Carbon, % wt | 13.8 |
| $H_2S$, wt ppm | 37 |
| Neutralization Number, mgr KOH/gr | 3.95 |
| MNI, % wt | 13.54 |
| Asphaltenes, % wt | 7.95 |
| UOP K Factor | 11.3 |

TABLE I-continued

| | |
|---|---|
| Viscosities: | |
| KV at 180° F., cst | 1184 |
| KV at 140° F., cst | 7558 |
| KV at 122° F., cst | 19229 |
| Metals Content: | |
| Iron, wt ppm | 19 |
| Vanadium, wt ppm | 396 |
| Nickel, wt ppm | 78 |

Most of the oils fall within the following composition and properties:

TABLE II

| | |
|---|---|
| Gravity, °API | 6–12 |
| Viscosities: | |
| KV at 180° F., cst | 400–2500 |
| KV at 140° F., cst | 2000–20000 |
| KV at 122° F., cst | 5000–40000 |
| Metals Content: | |
| Iron, wt ppm | 15–25 |
| Vanadium, wt ppm | 300–500 |
| Nickel, wt ppm | 60–120 |
| Asphaltenes, % wt | 6–12 |
| Salt Content as NaCl, Lbs/1000 BBls. | 35–1000 |
| Pour Point, °F. | 50–90 |
| Sulfur, % wt | 3.5–4.5 |
| Water and Sediments, % Vol | 0.2–10 |

The crude feedstock is supplied to the facility shown in the FIGURE via line 12. The heavy crude oil is mixed with a diluent at the production well and later at the facility the crude is mixed with additional diluent delivered to line 12 by way of primary line 14, recycled diluent line 16 and line 18. The use of the diluent is critical for a number of reasons. Firstly, the diluent lowers the viscosity and pour point of the crude so that it is not solid at room temperature thereby facilitating transport of the crude. Secondly, the diluent aids in controlling the temperatures and residence times in the facility thereby avoiding premature decomposition and therewith degradation of coker yields. The diluent should be mixed with the crude oil in an amount of from about 10 to about 50 percent volume. In accordance with the present invention, the diluent should be a narrow boiling hydrocarbon diluent having suitable solubility characteristics so as to avoid separation. The composition and properties of the diluent should fall within the following ranges:

TABLE III

| | |
|---|---|
| Gravity, °API | 20–65 |
| Viscosities: | |
| KV at 100° F., cst | 0.5–10.5 |
| KV at 210° F., cst | 0.1–3 |
| Distillation ASTM D-86 (°F.) | |
| IBP | 150–410 |
| 50% Vol | 200–610 |
| EP | 250–800 |

A diluent having the following composition and properties is preferred:

TABLE IV

| | |
|---|---|
| Gravity, °API | 35.4 |
| Sulfur, % wt | 0.48 |
| Pour Point, °F. | −25 |
| Water and Sediments, % Vol | 0.02 |
| Conradson Carbon, % wt | 0.05 |
| KV at 100° F., cst | 3.35 |
| KV at 122° F., cst | 2.78 |
| Distillation ASTM D-86 (°F.) | |

TABLE IV-continued

| | |
|---|---|
| IBP | 360 |
| 50% Vol | 496 |
| EP | 642 |

The incoming feedstock from line 12, which is mixed with diluent from line 18, is fed to a desalting station 20 comprising in series a dehydrator 22 and a first and second stage desalter 24 and 26, respectively. The water content of the crude oil is reduced in dehydrator 22 down to about 1.0 volume percent and the salt content is reduced in the dehydrator to about 150 PTB, and in the desalters 24 and 26 down to about 5 PTB. The temperature in the desalting station 29 should not exceed 275° F.

The desalted crude oil flows from desalter 26 to fired heater 28 where the crude is preheated to its desired crude tower feed inlet temperature and from there to an atmospheric pressure oil distillation unit 30 where it is separated into gases, liquid products and atmospheric residuum. The atmospheric distillation unit 30 is designed for several modes of operation.

In one operation, 500° F. plus residuum is produced and is drawn off and fed via line 32 to combination tower 34 for use as coker feed. The 500° F. minus overhead is drawn off through line 36 to splitter tower 38. The off gases from the atmospheric distillation unit 30 are removed through line 40 and passed to a gas scrubber of conventional design. The gas oil products from atmospheric distillation unit 30 are drawn off through line 42. The 500° F. minus overhead is fed to splitter tower 38 where naphtha and off gases are separated out as overhead products and drawn off through lines 44 and 46, respectively. The splitter tower bottom product is a narrow boiling 400° F.–500° F. liquid having properties and composition suitable for use as the diluent. The splitter bottom product is drawn off through line 16 and is recycled and mixed with the crude oil feedstock entering dehydrator 22.

In another mode of operation of atmospheric distillation unit 30, the unit will again produce a 500° F. minus overhead product which is drawn off and fed to splitter tower 38 via line 36. A 500° F. to 700° F. gas oil is produced and removed through line 42. The atmospheric residuum is a 700° F. plus product which is drawn off through line 32 to line 48 where it is fed to gas fired heater 50 where the atmospheric residuum is heated to its desired temperature and from there to vacuum distillation unit 52 for further processing. The atmospheric residuum is vacuum distilled in distillation unit 52 to produce a vaporized gas oil product which is drawn off through line 54 which may be recovered separately or combined with gas oil from the atmospheric unit 30. The vent gases from the vacuum distillation unit 52 are removed through line 56 and combined with the off gases from the atmospheric unit 30. The vacuum distillation unit is designed to produce from the atmospheric residue 900° F. plus vacuum residuum which is drawn off through line 58 and fed to combination tower 34 for use as coker feed via line 32.

The reduced crude coker feed from either of the above modes of operation is fed via line 32 to combination tower 34. Combination tower 34 comprises a heat transfer portion and a fractionator portion. The coker fresh feed from the atmospheric residuum or vacuum residuum flows via line 32 to the bottom section of combination tower 34 where it is heated by direct contact with coker effluent and fractionated to produce a reduced coker feed mixed with recycle. Coker feedstock is withdrawn from the bottom portion of combination tower 34 via line 60 and flows to coker heater 62 where the feedstock is heated to the desired temperature of about 920° F. The coker feedstock is heated as it passes through coker heater 62 and is fed via line 64 to one of several delayed coking drums, either coke drum 66 or coke drum 68, where the hydrocarbon feedstock decomposes leaving a mass of green coke. The coke drum vapor containing coker products and recycle is drawn off through line 70 and flows to the fractionation portion of combination tower 34. The recycle is condensed and mixed with the fresh feed in the bottom section of tower 34 while the coker products are fractionated into off gas, coker naphtha, coker distillate and coker gas. The above fractionated coker products are drawn off via lines 72, 74, 76 and 78, respectively. The unit is designed to operate normally with a recycle ratio of 0.1. However, if necessary the recycle ratio may be increased to 1.0 with a small reduction in fresh feed.

After sufficient coke is deposited in one coke drum, for example coke drum 66, the flow of the coker heater feedstock is switched to another coke drum 68 which has been preheated. The coke in coke drum 68 is then removed. The coke bed in the full drum is steam stripped and then cooled by water quenching. After draining of the water, the top and bottom heads of the drum are removed. The coke is then removed by hydraulic cutting and collected in a coke pit. Coke cutting water drained from the coke pit is collected through sluiceway and is pumped to storage tank for reuse. The empty drum is then reheated, steam purged and pressure tested. It is then reheated with superheated steam to about 70° F. and ready to receive the coking heater effluent again.

The coker liquid products may be further processed by hydrogenation to produce final products such as LPG, gasoline, kerosene, jet fuel, diesel oils and gas oils.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for the production of metallurgical coke from a heavy crude oil feedstock comprising:

(a) providing a crude oil feedstock inlet;

(b) feeding a crude oil feedstock to said crude oil inlet, said crude oil feedstock being characterized by the following composition and properties:

| | |
|---|---|
| Gravity, °API | 6–12 |
| Viscosities: | |
| KV at 180° F., cst | 400–2500 |
| KV at 140° F., cst | 2000–20000 |
| KV at 122° F., cst | 5000–40000 |
| Metals Content: | |
| Iron, wt ppm | 15–25 |
| Vanadium, wt ppm | 300–500 |
| Nickel, wt ppm | 60–120 |
| Asphaltenes, % wt | 6–12 |
| Salt Content as NaCl, Lbs/1000 BBls. | 35–1000 |
| Pour Point, °F. | 50–90 |
| Sulfur, % wt | 3.5–4.5 |
| Water and Sediments, % Vol | 0.2–10 |

(c) mixing said crude oil feedstock with a diluent in an amount equal to about 10 to 50% by volume, said diluent being characterized by a gravity of between 20 to 65 API and a boiling point range of between 150° F. and 800° F.;

(d) feeding the crude oil and diluent mixture to an atmospheric distillation unit wherein said crude oil and diluent mixture is subjected to distillation whereby gas products, a 500° F. minus liquid overheat hydrocarbon product and 500° F. plus residuum are produced;

(e) feeding the atmospheric distillation residuum to a combination tower comprising a heat transfer portion and a fractionator portion wherein said distillation residuum is subjected to fractionation so as to produce a reduced coker feed;

(f) withdrawing said reduced coker feed from the fractionator portion of said combination tower and passing said reduced coker feed to a delayed coking drum wherein the coker feed decomposes leaving a mass of metallurgical coke;

(g) recycling the coker effluent from said delayed coking drum directly to the fractionator portion of said combination tower;

(h) contacting said atmospheric distillation residuum with said coker effluent in the fractionator portion of said combination tower so as to produce a reduced coker feed mixed with recycle;

(i) withdrawing said coker feed mixed with recycle from the fractionator portion of said combination tower and passing said coker feed mixed with recycle to a delayed coking drum wherein the coker feed mixed with recycle decomposes leaving a mass of metallurgical coke; and (j) recycling the coker effluent from said delayed coking drum directly to the fractionator portion of said combination tower wherein said incoming atmospheric distillation residuum is contacted with the coker effluent.

2. A process according to claim 1 including subjecting said 500° F. minus liquid overhead hydrocarbon product to further treatment whereby naphtha and off gases are separated out as overhead products and a diluent having a boiling point range of about between 150° F. and 800° F. is produced.

3. A process according to claim 1 wherein the diluent has a viscosity of about 0.5 to 10.5 KV at 100° F., cst and of about 0.1 to 3.0 KV at 210° F., cst.

4. A process according to claim 1 including subjecting said 500° F. minus liquid overhead hydrocarbon product to further treatment whereby a diluent having a boiling point range of about 150° F. to 800° F., a specific gravity of about 20° to 65° API and a viscosity of about 0.5 to 10.5 KV at 100° F., cst and of about 0.1 to 3.0 KV at 210° F. is produced and recycling said diluent and mixing said diluent with the incoming crude oil feedstock so as to lower the viscosity and pour point of the heavy crude oil feedstock.

5. A process according to claim 1 including recycling said diluent and mixing said diluent with said incoming heavy crude oil at said crude oil inlet so as to lower the viscosity and pour point of the heavy crude oil feedstock and aid in the dehydration and desalting of the feedstock.

6. A process according to claim 3 including recycling said diluent and mixing said diluent with said incoming heavy crude oil at said crude oil inlet so as to lower the viscosity and pour point of the heavy crude oil feedstock and aid in the dehydration and desalting of the feedstock.

7. A process according to claim 1 including the steps of first dehydrating and thereafter desalting said crude oil and diluent mixture prior to atmospheric distillation so as to obtain a water content of about not more than 1 volume percent and a salt content of not more than about 5 PTB.

8. A process for the production of metallurgical coke from a heavy crude oil feedstock comprising:

(a) providing a crude oil feedstock inlet;

(b) feeding a crude oil feedstock to said crude oil inlet, said crude oil feedstock being characterized by the following composition and properties:

| | |
|---|---|
| Gravity, °API | 6–12 |
| Viscosities: | |
| KV at 180° F., cst | 400–2500 |
| KV at 140° F., cst | 2000–20000 |
| KV at 122° F., cst | 5000–40000 |
| Metals Content: | |
| Iron, wt ppm | 15–25 |
| Vanadium, wt ppm | 300–500 |
| Nickel, wt ppm | 60–120 |
| Asphaltenes, % wt | 6–12 |
| Salt Content as NaCl, Lbs/1000 BBls. | 35–1000 |
| Pour Point, °F. | 50–90 |
| Sulfur, % wt | 3.5–4.5 |
| Water and Sediments, % Vol | 0.2–10 |

(c) mixing said crude oil feedstock with diluent in an amount equal to about 10 to 50% by volume, said diluent being characterized by a gravity of between 20 to 65 API and a boiling point range of between 150° F. and 800° F.;

(d) feeding the crude oil and diluent mixture to an atmospheric distillation unit wherein said crude oil and diluent mixture is subjected to distillation whereby gas products, a 500° F. minus liquid overhead hydrocarbon product and a 700° F. plus residuum are produced;

(e) feeding the atmospheric distillation residuum to a vacuum distillation unit wherein said atmospheric distillation residuum is subjected to vacuum distillation whereby gas and liquid hydrocarbon distillate products and a 900° F. plus vacuum residuum are produced;

(f) feeding said vacuum residuum to a combination tower comprising a heat transfer portion and a fractionator portion wherein said vacuum residuum is subjected to fractionation so as to produce a reduced coker feed;

(g) withdrawing said reduced coker feed from the fractionator portion of said combination tower and passing said reduced coker feed to a delayed coking drum wherein the coker feed decomposes leaving a mass of metallurgical coke;

(h) recycling the coker effluent from said delayed coking drum directly to the fractionator portion of said combination tower;

(i) contacting said vacuum residuum with said coker effluent in the fractionator portion of said combination tower so as to produce a reduced coker feed mixed with recycle;

(j) withdrawing said coker feed mixed with recycle from the fractionator portion of said combination tower and passing said coker feed mixed with recycle to a delayed coking drum wherein the coker feed mixed with recycle decomposes leaving a mass of metallurgical coke; and (k) recycling the overhead products from said delayed coking drum directly to the fractionator portion of said combination tower wherein said incoming vacuum residuum is contacted with the coker effluent.

9. A process according to claim 3 including subjecting said 500° F. minus liquid overhead hydrocarbon product to further treatment whereby naphtha and off gases are separated out as overhead products and a diluent having a boiling point of about between 150° F. and 800° F. is produced.

10. A process according to claim 8 including passing said coker feed mixed with recycle through a furnace so as to heat said coker feed to a temperature of about 920° F. prior to feeding said coker feed to said delayed coking drum.

11. A process according to claim 8 wherein the diluent has a viscosity of about 0.5 to 10.5 KV at 100° F., cst and of about 0.1 to 3.0 KV at 210° F., cst.

12. A process according to claim 8 including subjecting said 500° F. minus liquid overhead hydrocarbon product to further treatment whereby a diluent having a boiling point range of about 150° F. to 800° F., a specific gravity of about 20° to 65° API and a viscosity of about 0.5 to 10.5 KV at 100° F., cst and of about 0.1 to 3.0 KV at 210° F. is produced and recycling said diluent and mixing said diluent with the incoming crude oil feedstock so as to lower the viscosity and pour point of the heavy crude oil feedstock.

13. A process according to claim 8 including the steps of first dehydrating and thereafter desalting said crude oil and diluent mixture prior to atmospheric distillation so as to obtain a water content of about not more than 1 volume percent and a salt content of not more than about 5 PTB.

* * * * *

UNITED STATES PATENT AND TRADEMARK OFFICE

CERTIFICATE OF CORRECTION

PATENT NO. : 4,551,232

DATED : November 5, 1985

INVENTOR(S) : Jose Luis Calderon et al.

It is certified that error appears in the above-identified patent and that said Letters Patent are hereby corrected as shown below:

In Column 8, line 26, claim 9, change the dependency from "claim 3" to --claim 8--.

Signed and Sealed this

*Fourteenth* Day of *January 1986*

[SEAL]

*Attest:*

*Attesting Officer*

DONALD J. QUIGG

*Commissioner of Patents and Trademarks*